United States Patent [19]

Arakawa

[11] Patent Number: 4,681,269

[45] Date of Patent: Jul. 21, 1987

[54] CONSTRUCTION OF BEARING FOR CONE CRUSHER

[75] Inventor: Kazuaki Arakawa, Osaka, Japan

[73] Assignee: Kurimoto Ltd., Japan

[21] Appl. No.: 924,184

[22] Filed: Oct. 24, 1986

Related U.S. Application Data

[63] Continuation of Ser. No. 721,624, Apr. 10, 1985, abandoned.

[30] Foreign Application Priority Data

Dec. 28, 1984 [JP] Japan ..... 59-279645

[51] Int. Cl.[4] ..... B02C 2/04

[52] U.S. Cl. ..... 241/101.2; 241/215

[58] Field of Search ..... 241/101.2, 207-216

[56] References Cited

U.S. PATENT DOCUMENTS 2,579,516 12/1951 Roubal ..... 241/215

*Primary Examiner*—Mark Rosenbaum

*Attorney, Agent, or Firm*—Jones, Tullar & Cooper

[57] ABSTRACT

A novel bearing construction for use in a cone crusher and the like in which an eccentric rotating in a frame and a crushing head gyrating in the inner periphery of the eccentric are movable up and down by hydraulic pressure. A cylindrical socket inserted in a sleeve of the frame is slidable up and down while the crushing head is supported by the upper part of the socket and the eccentric is supported by the lower part of the socket so that the bearing are prevented from wear and trouble during operation.

8 Claims, 4 Drawing Figures

CONSTRUCTION OF BEARING FOR CONE CRUSHER

This is a continuation of co-pending application Ser. No. 721,624 filed on Apr. 10, 1985, now abandoned.

BACKGROUND OF THE INVENTION

1. Field of the Invention

The present invention relates to improvements in the construction of a bearing incorporated in a cone crusher and the like to crush stones or ores.

2. Prior Art

According to the known structure of a cone crusher, a sleeve is either solidly provided at the center of a frame or is integrally fitted with the frame by a method such as shrinkage fitting, bolting or the like, and an eccentric is idly inserted in the sleeve to be rotated while transmitted a rotating force from a drive unit, thereby gyrating a crushing head which is eccentrically inserted inside of the eccentric. Thus, the ores or stones carried therein are crushed by the gyration in the area between a lower liner mounted on the top of the crushing head forming a cone shape and an upper liner mounted on the frame facing the lower liner. The size (grading) of the crushed ores (products) depends upon the discharge opening referred to as the C.S.S. (closed side setting), and therefore when the setting becomes larger as a result of wear of both liners, it is necessary to compensate for the wear of the two liners to maintain the specified grading. Furthermore, when the crusher is stopped because of biting such material as tramp irons which are impossible to be crushed, it is necessary to temporalily enlarge the setting for the tramp iron release.

In view of the foregoing necessity, the conventional cone crusher has an adjustment ring with a thread for the wear compensation and springs for the tramp iron release, but has no set-indication system, and therefore the wear compensation must be performed by the following procedure, i.e., loosening the adjustment ring, turning it, checking the state of the discharge opening to be suitable and fixing the adjustment ring.

In order to improve such a conventional method, a cone crusher including a hydraulic mechanism has been proposed so that the eccentric with which the crushing head is internally engaged may be moved up and down while a torque is applied, as is disclosed in Japanese Patent Publication (examined) No. 57-58216 (FIG. 4) or in Japanese Utility Model Publication (unexamined) No. 58-178345 (FIG. 3).

Even in case of such improved cone crushers, however, due to the nature of the mechanism thereof, it is unavoidable that a fluctuating load is applied together with impact and torsion, in a direction orthogonal to the inclined surface of the lower liner, to the effective crushing area where the discharge opening between the lower liner 15' and the upper liner 16' is minimized, and accordingly the bearing member of the rotating portion to which the considerable moment is directly applied cannot be free from severe conditions. In other words, in the case of a hydraulic cone crusher as shown in FIG. 3, it is known to mount a spherical bearing on the main shaft in order to support the crushing head, and as a result of such a structure, an impulsive dynamic load and the weight of the crushing head are concentrated onto the bearing member, which is forced to wear considerably.

In order to protect the bearing member from such severe impulsive load, a further improvement has been proposed, in which in place of mounting the spherical bearing on the main body 9' of the crushing head, the eccentric 2' is supported through an upper outer bushing 50' and a lower inner bushing 51' provided on the upper and lower parts of the frame respectively. A lower thrust wearing plate 53' is provided on the upper part of the pistons, and an upper thrust wearing plate 52' is fixedly provided, in the shape of a concave ring, between the top end of the eccentric 2' which supports the main shaft 10' of the crushing head and the bottom of the main body 9' thereof. According to this proposal, the durability of the bearing system of the crusher is further improved.

In the case of such a structure as shown in FIG. 4, however, the weight of the whole gyrating member composed of a main body 9', a main shaft 10', a lower liner 15', etc., and the fluctuating impact load when crushing the feed materials by gyration are supported by the upper thrust wearing plate 52'. Since the upper thrust wearing plate 52' is fixedly provided on the top of the eccentric 2', it rotates at high speed together with the eccentric 2' to which the driving force is transmitted. Since the upper thrust wearing plate 52' rotates at high speed while supporting the considerable weight as a thrust bearing, problems such as easily breaking or exhausting the oil film is still unavoidable, resulting in seizure of the thrust bearing thereby. The situation is quite the same for the lower thrust wearing plate.

SUMMARY OF THE INVENTION

It is therefore an object of the present invention to provide a novel bearing construction for use in a hydraulic cone crusher in which even during the operation thereof the eccentric including the crushing head is freely movable up and down, thereby each thrust bearing which receives impacts when crushing is not worn out or seized in a short period.

In order to accomplish the foregoing object, a bearing construction in accordance with the present invention is characterized in that a cylindrical socket inserted in a sleeve of the frame is slidable up and down while the crushing head being supported by the upper part of the socket and the eccentric are supported by the lower part of the socket.

More specifically, the bearing construction for a cone crusher according to the present invention is characterized in that a cylindrical socket 6 movable up and down is mounted in the inner periphery of a sleeve 4 vertically provided in a frame 1, an eccentric 2 rotatably provided in the inner periphery of the socket 6 is engaged with a drive unit to be slidable up and down, a crushing head 3 is rotatably and eccentrically inserted in the inner periphery of the eccentric, the crushing head 3 is supported by mounting a socket liner 7 on the upper part of the socket 6, and the eccentric 2 is supported by mounting a step bearing 8 on the lower part of the socket 6.

By adopting the foregoing bearing construction for a cone crusher and the like, the impulsive dynamic load is supported without breaking or exhausting the oil film which results in seizure, and the static load or weight is supported by the step bearing since the socket liner supporting the crushing head does not rotate at high speed. In this manner, by mutual collaboration between the two bearings, such trouble as partial wear, seizure, etc. of the bearing can be sufficiently prevented.

Other objects, features and advantages of the present invention will become apparent in the course of the following description with the accompanying drawings.

BRIEF DESCRIPTION OF THE DRAWINGS

In the accompany drawings forming a part of the present application, and in which like parts are designated reference numerals throughout the same.

DESCRIPTION OF THE PREFERRED EMBODIMENTS

Referring now to the accompanying drawings some of the preferred embodiments are described in detail hereunder.

Figure 1:
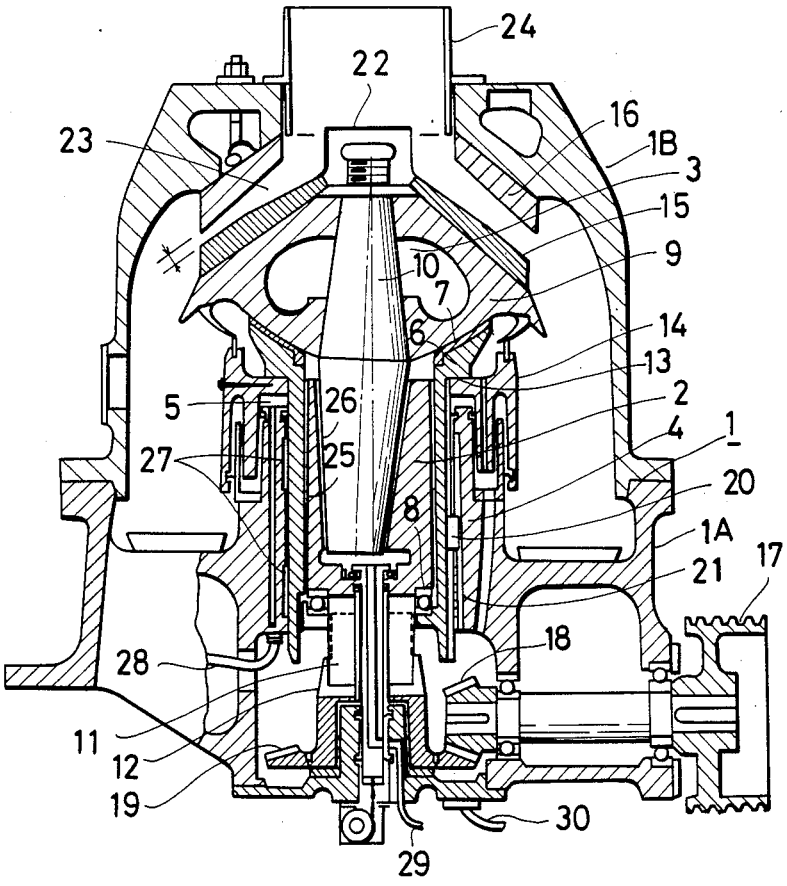
FIG. 1 is a front sectional view showing a first embodiment of the present invention.

FIG. 1 showing a preferred embodiment of the present invention, a frame 1 comprises a lower frame 1A and an upper frame 1B combined with each other, and the side of the bottom of the lower frame 1A is connected with a drive unit. In other words, the power from the drive source located outside the crusher is transmitted to a pulley 17 to rotate a pinion 18 provided at the end of the same shaft. Rotation of the pinion 18 is converted to the rotation of a gear 19 engaged with the pinion 18. The upper end of the body portion of the gear 19 is formed to be a lower coupling of large depth to be engaged with an upper coupling 11. Since couplings 11, 12 are engaged with each other with sufficient depth, when the upper coupling 11 is moved up and down by a required distance, a sufficient length of engagement as well as strength is assured so as to prevent disengagement.

The upper coupling 11 is located at the lower part of the eccentric 2, and the main shaft 10 of the crushing head is rotatably inserted in the inner periphery of the eccentric 2. The eccentric 2 is supported by the step bearing 8 mounted on the lower and inner periphery of the socket 6 together with the gyrating member assembled on the eccentric 2.

A key 20 is projectingly provided on the side of the socket 6, and this key 20 is inserted in a key groove 21 provided on the inner periphery of the sleeve 4 in the axial direction to prevent the socket from rotation but making it movable up and down. A concave is formed on the upper end of the socket 6 onto which a spherical bearing is adapted as the socket liner 7.

In this first embodiment, a hydraulic fluid chamber 5 for moving an outer cylinder 14, the socket 6, the eccentric 2, the crushing head 3 (a main body 9 and a main shaft 10 thereof), etc. up and down is provided on the top of the sleeve 4 forming a ring. The upper part of the hydraulic fluid chamber 5 is connected with a head supporting plate 13 provided on the upper and outer periphery of the socket 6 through the outer cylinder 14 movable up and down, and when hydraulic pressure is applied to the hydraulic fluid chamber 5 from outside, a moving-up force is transmitted sequentially to the outer cylinder 14, the socket 6, the eccentric 2 (while rotating) and the crushing head 3 (while gyrating).

Numeral 22 is a head nut to be mounted on the head of the main shaft 10, and numeral 23 is a crushing chamber which is formed by a spacing between the lower liner 15 and the upper liner 16. Numeral 24 is a feed hopper of the materials to be crushed such as ores, stones or the like. Numerals 25 and 26 are an outer bushing and an inner bushing mounted respectively on the outer periphery and the inner periphery of the eccentric 2, and numeral 27 is a cylinder bushing mounted on the outer periphery of the socket 6. Numeral 28 is a hydraulic line pipe, numeral 29 is a lube feeding pipe, and numeral 30 is a return lube pipe.

Since the cone crusher of this embodiment is constructed as described above, when the drive unit is started, the eccentric 2 connected therewith starts rotating. When the eccentric 2 rotates, the crushing head 3 inserted eccentrically in the inner periphery of the eccentric 2 starts a gyrating movement. In this connection, although the torque is not transmitted to the crushing head 3, since the crushing head 3 is rotatably inserted in the eccentric 2, the crushing head 3 rotates slowly by the friction.

The socket 6 is provided on the outer periphery of the eccentric and the sleeve 4 is fixed onto the frame 1 on the further outer periphery of the socket 6, but the torque of the eccentric 2 is not transmitted thereto structurally.

With respect to the supporting manner of the load to be applied, the weight of the crushing head 3 (including the other gyrating members) and the impulsive dynamic load applied in accordance with the gyration for crushing are dividedly supported by the socket liner 7 provided on the top of the non-rotatable socket 6 and by the step bearing 8 provided on the lower part, respectively. In view of the foregoing mechanism, the dynamic load is mainly applied to the socket liner 7, but the member to be supported is the crushing head 3 which rotates very slowly by inertia. On the other hand, the weight of each member is mainly applied to the step bearing 8 by which the eccentric 2 rotating at high speed is to be supported. In this case, almost all of the impulsive and fluctuating load is absorbed by the socket liner 7, thereby only the weight of the eccentric 2 is applied to the step bearing 8. Consequently, there remains no problem caused by the rotation at high speed of the member to be supported.

Figure 2:
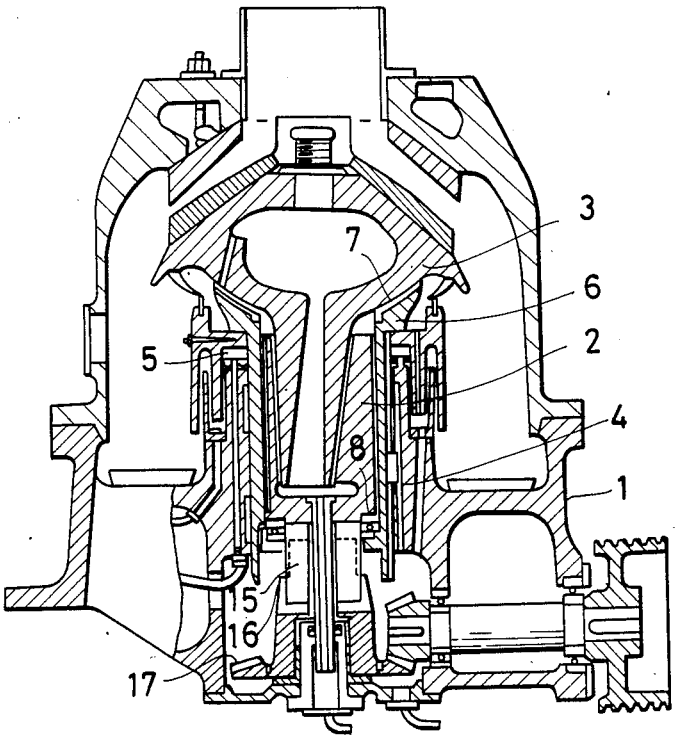
FIG. 2 is a front sectional view showing a second embodiment of the present invention.
Figure 3:
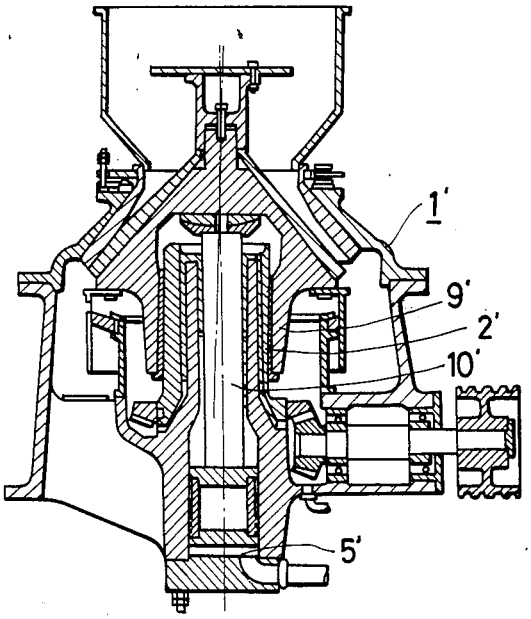
FIG. 3 (Prior Art)
FIGS. 3 and 4 are front sectional views respectively showing the different prior arts.
Figure 4:
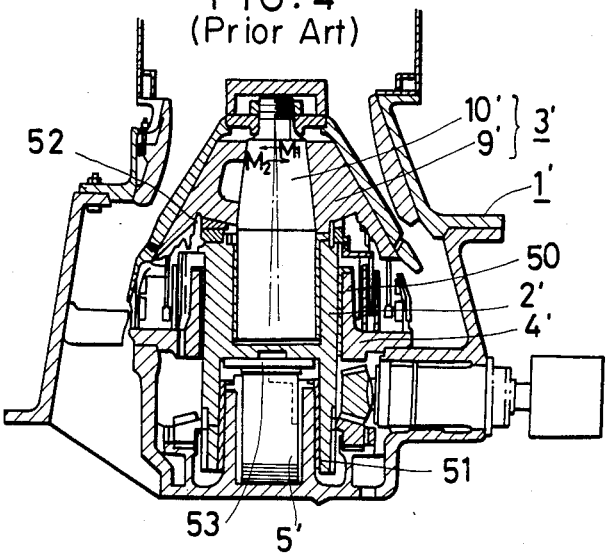
FIG. 4 (Prior Art)

Referring next to FIG. 2 showing the second embodiment of the present invention, the crushing head 3 is formed to be solid, hollow and mushroom shaped without distinction between the main body and the main shaft thereof.

With respect to the position of the hydraulic fluid chamber, it is also possible for this chamber to be ring like on the bottom part of the socket 6 through the outer cylinder and the piston. It is, however, not preferred to provide the hydraulic fluid chamber on the bottom part of the crusher compared with the foregoing embodiments since the overall height of the crusher becomes excessively large.

As the present invention may be embodied in several forms without departing from the spirit of the essential characteristics thereof, the foregoing embodiments are therefore illustrative and not restrictive, since the scope of the invention is defined by the appended claims rather than by the preceeding description, and all changes that fall within meets and bounds of the claims, or equivalence of such meets and and bounds are therefore intended to be embraced by the claims.

What is claimed is:

1. A cone crusher comprising a frame defining a sleeve having an upper end an eccentric situated for rotation within the frame, and a lower end, a cylindrical socket situated for reciprocal movement within the sleeve, said eccentric extending into and being supported by the socket, a crushing head situated to gyrate relative to the eccentric, means for producing hydraulic pressure for reciprocating the eccentric and crushing head, and bearing construction including bearing means situated at the upper end of said socket for supporting the crushing head, and further bearing means situated at the lower end of said socket for supporting the eccentric.

2. The cone crusher as defined in claim 1, wherein said bearing means comprises a socket liner, and said further bearing means comprises a step bearing.

3. The cone crusher as defined in claim 2, wherein the crushing head comprises a cone-shaped body and a main shaft inserted in said body.

4. The cone crusher as defined in claim 2, wherein the crushing head comprises a mushroom-shaped hollow solid.

5. A cone crusher as defined in claim 2, further comprising a lower coupling, and a drive unit, wherein an upper coupling having long teeth is formed on the lower side of the eccentric for engagement with the lower. coupling of the drive unit for reciprocal movement.

6. The cone crusher as defined in claim 1, wherein the crushing head comprises a cone-shaped body and a main shaft inserted in said body.

7. A cone crusher as defined in claim 1, wherein the crushing head is formed to be solid, hollow and mushroom-shaped.

8. A cone crusher as defined in claim 1, further comprising a lower coupling, and a drive unit, wherein an upper coupling having long teeth is formed on the lower side of the eccentric for engagement with the lower coupling of the drive unit for reciprocal movement.

* * * * *